US005328166A

United States Patent [19]

Hokamura

[11] Patent Number: 5,328,166

[45] Date of Patent: Jul. 12, 1994

[54] RECORDING PAPER SIZE DISCRIMINATING STRUCTURE

[75] Inventor: Satoshi Hokamura, Saitama, Japan

[73] Assignee: Asahi Kogaku Kogyo Kabushiki Kaisha, Tokyo, Japan

[21] Appl. No.: 935,187

[22] Filed: Aug. 26, 1992

[30] Foreign Application Priority Data

Aug. 27, 1991 [JP] Japan ..... 3-296728

[51] Int. Cl.[5] ..... B65H 1/00

[52] U.S. Cl. ..... 271/171; 271/265; 355/311; 355/72

[58] Field of Search ..... 355/311, 75, 74, 72, 355/133; 271/171, 265, 9

[56] References Cited

U.S. PATENT DOCUMENTS 4,786,042 11/1988 Stemmle ..... 271/9
4,966,356 10/1990 Ohyabu et al. ..... 271/9
5,093,688 3/1992 Komiya ..... 355/204
5,110,106 5/1992 Matsumura et al. ..... 271/9
5,121,169 6/1992 Kawabata ..... 355/311

FOREIGN PATENT DOCUMENTS 57-202560 12/1982 Japan ..... 355/311
57-210359 12/1982 Japan ..... 355/311
58-4155 1/1983 Japan ..... 355/311
60-86559 5/1985 Japan ..... 355/311

*Primary Examiner*—R. L. Moses
*Attorney, Agent, or Firm*—Sandler, Greenblum & Bernstein

[57] ABSTRACT

A recording paper size discriminating structure is provided for discriminating a recording paper size of recording papers which are accommodated in a recording paper cassette which is detachably attached to an imaging apparatus. The recording papers are cut in a predetermined size. The structure is provided with a guide plate for identifying the accommodated recording papers, and sensors for detecting the guide plate. The guide plate is provided on the recording paper cassette and the sensors are disposed at the imaging apparatus.

9 Claims, 3 Drawing Sheets

RECORDING PAPER SIZE DISCRIMINATING STRUCTURE

BACKGROUND OF THE INVENTION

The present invention relates to a recording paper size discriminating structure callable or discriminating the size of the recording paper contained in the recording paper cassette which is installed at a paper feeding portion or an imaging apparatus so that recording paper can be fed from the recording paper cassette to the image forming portion of the imaging apparatus to Form images on it.

Conventionally, an imaging apparatus such as a copy machine, a printer, a facsimile machine and the like are known which are characterized in that an image formation is carried out by use of plain paper being cut in a predetermined size.

In such an imaging apparatus, recording papers (plain papers) are usually contained or accommodated in a recording paper cassette so as to be piled up or stacked in it. Namely, the recording paper cassette is detachably installed at a paper feeding portion of the imaging apparatus. Recording paper is fed one by one from the recording paper cassette to an image forming portion of the imaging apparatus.

Recording papers are classified into a plurality of predetermined sizes. Therefore, a typical imaging apparatus is constituted in such a manner that a plurality of recording cassettes which are respectively made in the different sizes or recording papers can be simultaneously installed so as to correspond to these various recording paper sizes. Especially, this kind of constitution is essential for recent copy machines.

However, the recording paper cassettes are normally made to have the same outer configuration in order to mate with a common cassette coupling portion formed on the imaging apparatus. On the other hand, their inside spaces are partitioned exclusively for fitting any one of respective recording paper sizes.

For this reason, users need to prepare a significant number of recording paper cassettes equal to the number of recording paper sizes they intend to use. If they further want to use recording paper or a different size which has not been used, a recording paper cassette corresponding to this size needs to be newly prepared or added. As a result many recording paper cassettes suited for respective different recording paper sizes are required even though their outer configurations are the same which is unreasonable.

Moreover, in such an imaging apparatus equipped with a recording paper cassette, especially in the ease where a plurality of recording paper cassettes are simultaneously installed, it is necessary to discriminate currently usable recording paper sizes; i.e. recording paper sizes contained in the recording paper cassettes simultaneously installed in the imaging apparatus at that time, and feed recording paper of a designated size from Lie corresponding recording paper cassette.

SUMMARY OF THE INVENTION

It is therefore an object of the present invention to provide a recording paper cassette which can switch or adjust a recording paper size to be accommodated therein so as to realize a recording paper cassette compatible with a plurality of differently sized recording papers, and a recording paper size discriminating structure which can discriminate a recording paper size which is presently accommodated in the recording paper cassette.

In order to accomplish the above purposes, the present invention provides a recording paper size discriminating structure for discriminating a recording paper size of recording papers which are accommodated in a recording paper cassettes which is detachably attached to an imaging apparatus and are cut in a predetermined size, Marking means identify the accommodated recording papers, marking means being provided on the recording paper cassette. Detecting means detect the marking means, and the detecting means are disposed at the imaging apparatus.

With the above constitution, a recording paper cassette has compatibility with respect to a plurality of recording papers having different sizes. And, the recording paper size can be discriminated by detecting the marking means representing the accommodated recording paper size by means of the detecting means disposed at the imaging apparatus.

The above and ocher objects, features and advantages of the present invention will become more apparent from the following detailed description which is to be read in conjunction with the accompanying drawings.

BRIEF DESCRIPTION OF THE DRAWINGS

FIG. 8 is a plan view showing the recording paper cassette.

DESCRIPTION OF THE EMBODIMENT

Hereinafter, referring now to the accompanying drawings, a preferred embodiment of the present invention is explained in detail.

Figure 1:
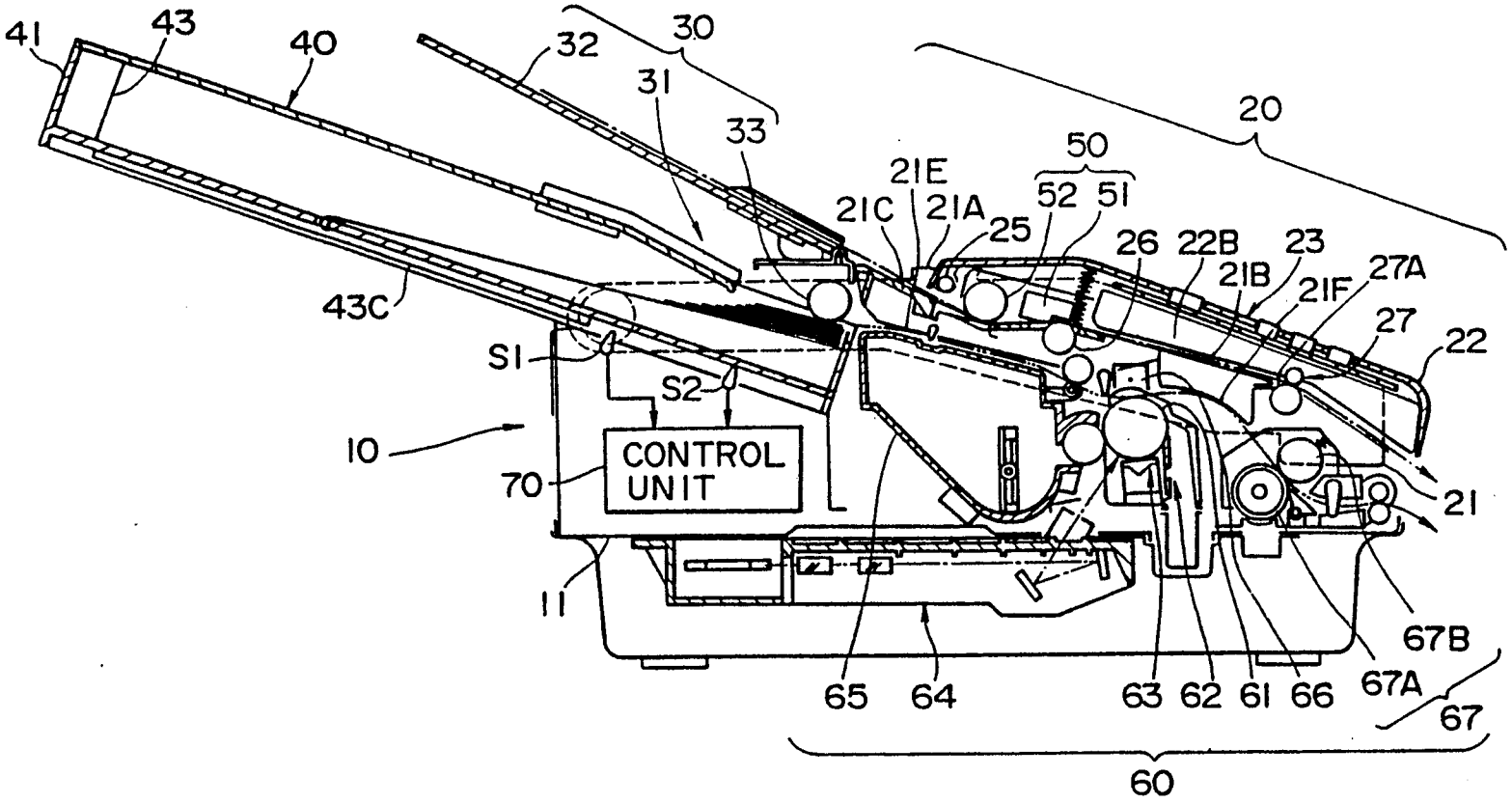
FIG. 1 is a side view showing a schematic constitution of an electro-photographic facsimile apparatus serving as an imaging apparatus embodying a recording paper size discriminating structure of the present invention.

FIG. 1 shows a schematic constitution of an electrophotographic facsimile machine serving as an imaging apparatus embodying a recording paper size discriminating structure of the present invention. This drawing is a cross-sectional side view, and a right end in this drawing corresponds to a front side of the electrophotographic facsimile machine.

This facsimile machine includes a main body 10 and a paper feeding portion 30. The paper feeding portion 30 is provided at a rear upper end of the main body 10 for supplying or feeding recording papers to receive transmitted images or manuscripts to be transmitted. The main body 10 further includes an upper body 20 at an upper front side of the apparatus. This upper body 20 is hingedly supported through an arm 21A which is provided close to a paper feeding portion 30 (i.e. at a rear end of the upper body 20).

The paper feeding portion 30 includes a cassette installation portion 31 and a manuscript holder 32. A recording paper cassette 40 accommodates or contains recording papers being cut and suitable for receiving communication data or images. And, this recording paper cassette 40 is detachably engaged with the cassette installation portion 31 so that recording papers are fed into the main body 10. The manuscript holder 32 is disposed at an upper front (upper right in the drawing) side of the cassette installation portion 31.

The cassette installation portion 31 is equipped with a pair of sensors S1 and S2 at different portions, and are spaced at a predetermined distance in a back-and-forth direction so as to face a lower surface of the recording paper cassette 40 widen the recording paper cassette 40 is engaged with the cassette installation portion 31.

Signals detected by these sensors S1 and S2 are inputted into a control unit 70 of this facsimile machine. Furthermore, there is provided a recording paper feeding roller 33 at a portion corresponding to an upper front end of recording papers accommodated the recording paper cassette 40.

An upper surface of the upper body 20 is formed as a moderately inclined surface descending toward the front end of the main body 30. On this inclined surface, a display panel or operation buttons and the like are arranged to constitute an operation portion 23.

In an inside space of the upper body 20, there is provided a reading head 50 including a reading sensor 51 and a manuscript feeding roller 52. The manuscript feeding roller 52 is disposed adjacent to the manuscript holder 32. With this arrangement, a manuscript to be transmitted is first laid on the manuscript holder 32, and then fed into the upper body 20 by being guided by the manuscript feeding roller 52. Then, the manuscript is conveyed along a path indicated by an alternate long and short dash line of FIG. 1. During this conveyance, information written or involved in the manuscript are read by the reading sensor 51. And, the manuscript is taken out from an outlet formed at a front end of the apparatus.

On the other hand, a recording portion 60 is provided in the main body 10 as an image forming functional portion comprising various functional mechanisms.

The recording portion 60 includes a sensitized drum 61 driven by a motor (not shown) to rotate at a predetermined speed. Around a circumferential surface of the sensitized drum 61, there are disposed a cleaning mechanism 62 which has an elastic blade to slide on the circumferential surface to clean up toner remaining on the circumferential surface, a corona charger 63 which uniformly charges the circumferential surface of the sensitized drum 61, a scanning optics unit 64 which performs an exposure scanning on the surface of the sensitized drum 61 by use of a laser beam being on-off controlled on the basis of image information, a developing unit 65 which forms toner images by adhering Loner on the sensitized drum being formed with latent images by excluding electric charges through the exposure scanning, and a transfer charger 66 which charges a recording paper and transfers the toner images on the charged recording paper.

Furthermore, there is provided a fixing unit 67 downstream of the transfer charger 66 on the recording paper conveyance path. This fixing unit 67 is constituted by a heat roller 67A, which maintains its temperature at a predetermined value, and a press roller 67B, which is disposed at upper front side of the heat roller 67A.

By rotating the recording paper feeding roller 33 provided in the cassette installation portion 31, the recording papers accommodated in the recording paper cassette 40 are successively fed into the recording paper passage. On the other hand, the scanning optics unit 64 is modulated on the basis of the received printed letters or received image information and emits a laser beam to carry out a main scanning (exposure) on the surface of the sensitized drum 61 along its rotational axis direction and an auxiliary scanning by rotating the sensitized drum 61. As a result of this exposure scanning, latent images are formed on the sensitized drum 61.

The thus formed latent images are developed to form toner images in the developing unit 65. These toner images are further conveyed along a path indicated by an alternate long and two short dashed line of FIG. 1, and transferred on the charged recording paper by the transfer charger 66. And finally, the fixing unit 67 fixes toner images on the recording paper and sends out the finished recording paper from the front end of the apparatus.

Figure 2:
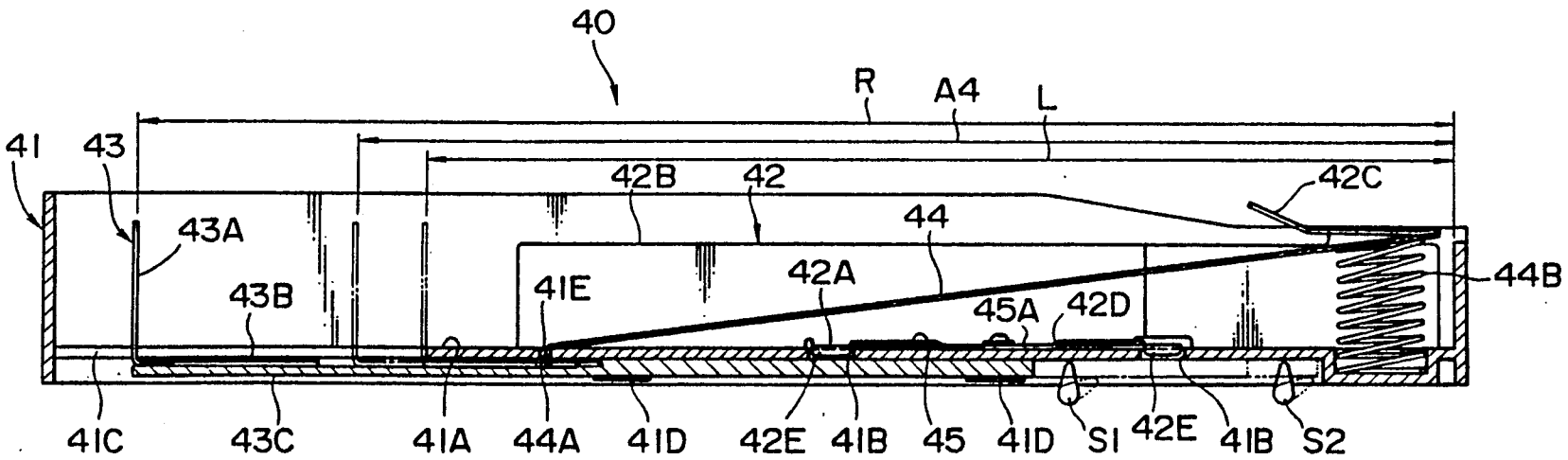
FIG. 2 is a vertical cross-sectional view showing the recording paper cassette.
Figure 3:
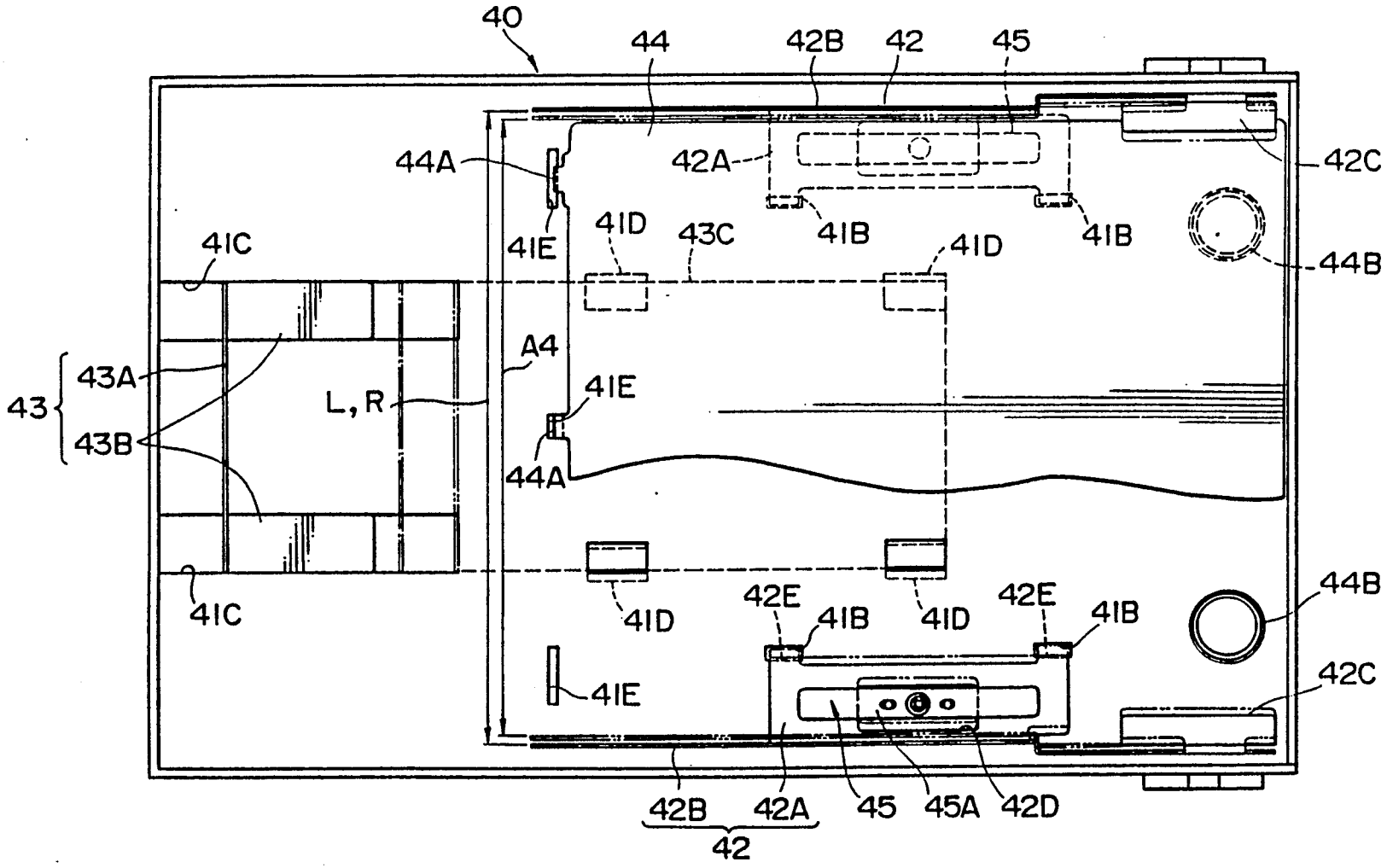

The recording paper cassette 40 is shown in detail in FIG. 2 (a cross-sectional view) and FIG. 3 (a plan view). The recording paper cassette 40 includes a container portion 41, which serves as a recording paper container and has a shallow rectangular parallelopiped configuration with an open top and a rectangle cross section along a plane surface.

In this container portion 41, there are provided a pair of side-edge regulating plates 42, 42 for regulating side edges of accommodated recording papers, a rear-edge regulating plate 43 for regulating rear edges or the accommodated recording papers, and a recording paper supporting plate 44 for supporting the accommodated recording papers from the bottom.

The side-edge regulating plates 42, 42 are disposed in parallel with each other at both sides of a front end of the container portion 41. The rear-edge regulating plate 43 is disposed at a rear end of the container portion 41. And, the recording paper supporting plate 44 is disposed at a position being sandwiched between the side-edge regulating plates 42, 42.

The side-edge regulating plate 42 consists of a supporting base 42A and a side plate 42B to have an L-shaped cross section. The supporting base 42A is secured on a base plate 41A of the container portion 41, and the side plate 42B is formed to extend vertically from one end of the supporting base 42A to have a predetermined height.

At an upper front edge of the side plate 42B, there is provided a pair of recording paper stoppers 42C which are bent laterally inward so as to regulate the accommodated recording papers from the top.

At a central portion of the supporting base 42A there is an open rectangular installation hole 42D extending in a back-and-forth direction. The supporting base 42A is Fixed to the base plate 41A by means of a fitting 45 which is inserted through the installation hole 42D.

The fitting 45 is made in a plate shape with a width narrower than the installation hole 42D. The fitting 45 was an installation surface portion 45A at its central portion which extends into the installation hole 42D. And both end portions of the fitting 45 are elongated from the installation surface portion 45A, which are bent and raised by an amount of a thickness of the side-edge regulating plate 42. That is, the installation surface portion 45A is constituted to fit the installation hole 42D from the upper side of the supporting base 42A of the side-edge regulating plate 42 so as to be fixed by a screw.

With this arrangement the side-edge regulating plate 42 can be slidable in a width direction within a margin of the width of the installation hole 42D with respect to the width of the fitting 45.

The supporting base 42A has a pair of engaging projections 42E, 42E formed at front and rear ends of the supporting base 42A and being bent to extend downward from a laterally inner edge of the supporting base 42A. These engaging projections 42E, 42E are inserted into engaging holes 41B, 41B formed on the base plate 41A of the container portion 41. Therefore, these engaging projections 42E, 42E are restricted by the engaging holes 41B, 41B when they move in the width direction. That is, this structure prevents the side-edge regulating plate 42 from shifting in the width direction.

With the above-described constitution of the side-edge regulating plate 42, the right and left side-edge regulating plates 42, 42 can be adjusted to fit two different paper widths of recording papers by changing a distance between both side-edge regulating plates 42, 42 in a contracting direction and an expanding direction. In this embodiment, recording papers of an A4 size; A4, and letter&legal sizes; L and R, are adjustable in the recording paper cassette 40.

Through the right and left side-edge regulating plates 42, 42 are constituted to be independently adjustable in tilts embodiment, it is possible to shift these side-edge regulating plates 42, 42 together by use of an appropriate mechanism such as a rack-and-pinion mechanism or the like.

The rear-edge regulating plate 43 includes a plate-shaped regulating plate portion 43A for regulating rear edges of the recording papers and leg portions 43B, 43B having predetermined widths and extending from both side edges of the regulating plate portion 43A toward the front end of the container portion 41 along the base plate 41A.

These leg portions 43B, 43B are inserted into through-holes 41C, 41C formed at a base plate 41A of the container portion 41 so as to penetrate the container from its inside to its reverse side. And, these leg portions 43B, 43B are supported from the bottom by a guide plate 43C extending in the back-and-forth direction, so that the rear end regulating plate 43 is prevented from falling off.

The guide plate 43C is supported by four supporting guide projections 41D, . . . , 41D provided on the reverse surface of the base plate 41A so as to be slidable in the back-and-forth direction. With this construction, the rear-edge regulating plate 43 can slide back-and-forth within a margin allowed by the through-holes 41C, 41C.

Furthermore, this guide plate 43C serves as a marking means of the present invention, details of which is described later.

A back-and-forth shift movement of the rear edge regulating plate 43 is restricted by the through-holes 41C, 41C, as described above. Thus, in this embodiment, a distance from the front edge of the container portion 41 to the rear-edge regulating plate 43 can be adjustable to Fit three kind of recording papers of an A4 size; A4, a letter size; L, and a legal size; R.

The recording paper supporting plate 44 is made in a rectangular shape having an appropriate width so as not to interfere with side places 42B, 42B even in the case where the gap between these side plates 42B, 42B is most narrowed. The recording paper supporting plate 44 has three hooks 44A, 44A, 44A (only 2 hooks being shown in FIG. 2) being bent downward from its rear edge.

These hooks 44A, 44A, and 44A engage with engaging holes 41E, 41E, and 41E formed on the base plate 41A of the container 41. In particular, the recording paper supporting plate 44 is hingedly supported between the both side plate 42B, 42B so tidal its front end can swing in an up-and-down direction.

A pair of springs 44B, 44B are provided between the front end or the recording paper supporting plate 44 and the base plate 41A or the container portion 41. Thus, the front edge of recording paper supporting plate 44 is urged Lo raise by the springs 44B, 44B.

FIG. 2 shows an empty condition wherein no recording paper is accommodated. In this condition, the front edge of the recording paper supporting plate 44 is urged upward by the springs 44B, 44B to abut the recording paper stoppers 42C, 42C.

On the other hand, if recording papers are once accommodated in the recording paper cassette 40, an upper surface of the uppermost recording paper abuts the recording paper stoppers 42C, 42C.

Furthermore, if the recording paper cassette 40 is attached to or engaged with the paper feeding portion 30 of the facsimile machine as shown in FIG. 1, the recording paper feeding roller 33 is positioned lower than the recording paper stoppers 42C, 42C. Therefore, in this condition, an upper surface of the uppermost recording paper abuts a circumferential surface of the recording paper feeding roller 33 by being urged by the springs 44B, 44B.

Accordingly, in accordance with the above-described constitution, the recording paper cassette 40 can be adjusted to fig three kinds of recording paper sizes of the A4 size, the letter size, and the legal size by changing the gap between the side-edge regulating plates 42, 42 in the width direction and also moving the rear-edge regulating plate 43 in the back-and-forth direction.

In other words, by adjusting the positions or the side-edge regulating plates 42, 42 and the rear edge regulating plate 43 in accordance with the size of recording papers to be used, it becomes possible to flexibly accommodate a plurality of different size recording papers in the same recording paper cassette.

Here, in accordance with the present invention three kinds of recording papers have different longitudinal lengths. Therefore, the kind of recording papers accommodated in the recording paper cassette 40 can be judged by detecting the position of the rear-edge regulating plate 43 in the back-and-forth direction.

The sensors S1 and S2 provided in the cassette installation portion 31 of the paper Feeding portion 30 in the facsimile machine are disposed to have their detecting areas corresponding to a shifting area of the guide place 43C in the condition where the recording paper cassette 40 is installed.

Moreover, the disposed positions of the sensors S1 and S2 are designed in such a manner that both sensors S1 and S2 do not detect the guide plate 43C in the case where the recording paper cassette 40 accommodates the recording papers of a legal size which is the longest size capable of being accommodated therein. (Refer to the solid line or FIG. 2)

On the other hand, when the recording paper cassette 40 accommodates the recording papers of the A4 size which is an intermediate length, only the rear side sensor S1 detects the guide plate 43C. (Refer to the alternate long and short dash line) Furthermore, in the case where the recording paper cassette 40 accommodates the recording papers or the letter size which is the shortest size, both the sensors S1 and S2 detect the guide plate 43C. (Refer to the alternate long and two dashed line)

The control unit 70 of the facsimile machine inputs signals from the sensors S1 and S2 and judges the kind of the recording paper which is accommodated in the recording paper cassette 40 From these signals representing the position of the guide plate 43C. By utilizing these detected signals as control information, an image Formation (i.e. a printout) can be executed in accordance with the size of the recording paper.

That is, when both sensors S1 and S2 do not generate detection signals, the control unit 70 judges that the accommodated recording paper size is the legal size. When the sensor S1 generates a detection signal but the sensor S2 does not generate a detecting signal, the control unit 70 judges that the accommodated recording paper size is the A4 size. Furthermore, when both sensors S1 and S2 generate detection signals, the control unit 70 judges that the accommodated recording paper size is the letter size.

Hence, irrespective of a size of a transmitted manuscript, an image Formation can be carried out in accordance with the recording paper accommodated in the recording paper cassette 40 engaged with the cassette installation portion 31.

With above-described constitution, a recording paper cassette can adjust an accommodating recording paper size to have a compatibility with respect to a plurality of different size recording papers. And, the recording paper size can be discriminated by detecting the marking means representing or identifying the accommodated recording paper size by means of the detecting means disposed at the imaging apparatus side. Consequently, the image formation can be realized in accordance with the recording paper size.

As this invention may be embodied in several forms without departing from the spirit or essential characteristics thereof, the present embodiment is therefore illustrative and not restrictive, since the scope or the invention is defined by the appending claims rather than by the description preceding them, and all changes that fall within meets and bounds of the claims, or equivalence of such meets and bounds are therefore intended to be embraced by the claims.

The present invention relates to subject matter contained in Japanese Patent Application No. HEI 3-296728 (filed on Aug. 27, 1992) which is expressly incorporated herein by reference in its entirety.

What is claimed is:

1. A recording paper size discriminating structure for discriminating a recording paper size of recording papers which are accommodated in a recording paper cassette, the recording paper cassette being detachably attached to an imaging apparatus, the recording paper cassette including opposed side edges, a front edge, and a rear edge, the opposed side edges and the front and rear edges defining a periphery of said recording paper cassette, and wherein the recording papers are cut in a predetermined size, said recording paper size discriminating structure comprising:

means for identifying said accommodated recording papers, said means for identifying being provided on and within the periphery of the recording paper cassette; and detecting means for contacting and detecting said means for identifying, said detecting means being disposed on said imaging apparatus and within the periphery of the recording paper cassette, when the recording paper cassette is attached to the imaging apparatus.

2. A recording paper size discriminating structure in accordance with claim 1, wherein said recording paper cassette is set to be capable of accommodating a plurality of recording papers having different sizes, said means for identifying is shiftable corresponding to the size of said recording papers accommodated in said recording paper cassette, and said detecting means is disposed to correspond to a shifting range of said means for identifying.

3. A recording paper size discriminating structure in accordance with claim 2, wherein said recording paper cassette includes a recording paper container portion, and a rear-edge regulating plate which is shiftable in a back-and-forth direction along a first surface of said paper container portion for registering rear edges of said recording papers, and, said means for identifying is provided on a second surface of said recording paper container portion so as to move together with said rear-edge regulating plate.

4. A recording paper size discriminating structure in accordance with claim 3, wherein said recording paper cassette is set to be capable of accommodating three kinds of recording papers having different lengths in a recording paper feeding direction, and said detecting means includes two sensors having detecting regions, said sensors detecting whether or not said means for identifying exists in their detecting regions.

5. A recording paper size discriminating structure in accordance with claim 4, wherein said two sensors of said detecting means are spaced at a predetermined distance from each other in such a manner that said two sensors do not detect said means for identifying in the case where said recording paper cassette accommodates the longest recording papers, and one of said sensors detects said means for identifying and the other sensor does not detect said means for identifying in the case where said recording paper cassette accommodates recording papers of an intermediate length, and further said two sensors detect said means for identifying in the case where said recording paper cassette accommodates the shortest recording papers.

6. A recording paper size discriminating structure in accordance with claim 1, wherein said recording paper cassette comprises:

a recording paper container portion;

a rear-edge regulating plate being shiftable in a back-and-forth direction along a first surface of said recording paper container portion for registering rear edges of recording papers; and said means for identifying being provided on a second surface of said recording paper container portion so as to move together with said rear-edge regulating plate.

7. A recording paper cassette in accordance with claim 6, wherein said rear-edge regulating plate and said means for identifying are integrally connected.

8. A recording paper size discriminating structure in accordance with claim 4, wherein recording papers are fed from the recording paper cassette in a recording paper feeding direction, said two sensors of said detecting means being spaced at a predetermined distance from each other in the recording paper feeding direction.

9. A recording paper size discriminating structure in accordance with claim 5, wherein recording papers are fed from the recording paper cassette in a recording paper feeding direction, said two sensors of said detecting means being spaced at said predetermined distance from each other in the recording paper feeding direction.

* * * * *